US007971287B2

(12) United States Patent
Buzzetti et al.

(10) Patent No.: US 7,971,287 B2
(45) Date of Patent: Jul. 5, 2011

(54) METHOD AND APPARATUS FOR AUTOMATICALLY LIFTING A COVER

(76) Inventors: Mike Buzzetti, Templeton, CA (US); Zachary C. Mansfield, Paso Robles, CA (US); Michael J. Mowrey, Paso Robles, CA (US)

( * ) Notice: Subject to any disclaimer, the term of this patent is extended or adjusted under 35 U.S.C. 154(b) by 1119 days.

(21) Appl. No.: 11/696,729

(22) Filed: Apr. 5, 2007

(65) Prior Publication Data

US 2007/0209104 A1 Sep. 13, 2007

Related U.S. Application Data

(63) Continuation-in-part of application No. 11/371,635, filed on Mar. 8, 2006, now Pat. No. 7,461,415.

(51) Int. Cl.
*E04H 4/00* (2006.01)

(52) U.S. Cl. ..... 4/498; 4/503

(58) Field of Classification Search ..... 4/498–502, 4/246.1–246.5

See application file for complete search history.

(56) References Cited

U.S. PATENT DOCUMENTS

| | | | |
|---|---|---|---|
| 3,366,855 | A | 1/1968 | Huber et al. |
| 5,950,252 | A | 9/1999 | Fettes |
| 6,032,305 | A | 3/2000 | Tedrick |
| 6,442,799 | B1 | 9/2002 | Duarte et al. |
| 6,795,984 | B1 | 9/2004 | Brady |
| 6,802,086 | B1 | 10/2004 | Hudzinski |
| 7,308,722 | B2 | 12/2007 | Koren |
| 2004/0139540 | A1 | 7/2004 | Lahay |
| 2004/0143895 | A1 | 7/2004 | Loyd et al. |
| 2005/0262226 | A1 | 11/2005 | Holloway et al. |
| 2006/0053543 | A1 | 3/2006 | Vargas et al. |
| 2006/0162060 | A1 | 7/2006 | Coleman et al. |
| 2007/0107118 | A1 | 5/2007 | Tudor |
| 2010/0313352 | A1* | 12/2010 | Sloss ..... 4/498 |

OTHER PUBLICATIONS

Reply to Office Action Jun. 17, 2008 of U.S. Appl. No. 11/371,635, filed Mar. 8, 2006.

Notice of Allowance Oct. 30, 2008 of U.S. Appl. No. 11/371,635, filed Mar. 8, 2006.

Office Action from U.S. Appl. No. 11/371,635 dated Jan. 5, 2007.

Office Action from U.S. Appl. No. 11/371,635 dated Jul. 31, 2007.

Interview Summary from U.S. Appl. No. 11/371,635 dated Jul. 31, 2007.

Advisory Action from U.S. Appl. No. 11/371,635 dated Oct. 22, 2007.

U.S. Appl. No. "11/371,635", Buzetti, Mike "U.S. Appl. No. 11/371,635".

Office Action, U.S. Appl. No. 11/371,635 dated Mar. 3, 2008.

* cited by examiner

*Primary Examiner* — Gregory L Huson
*Assistant Examiner* — Karen Younkins
(74) *Attorney, Agent, or Firm* — Philip Steiner

(57) ABSTRACT

An apparatus for lifting a cover from a spa or other housing includes a frame member having one end that is pivotally attached to the exterior of the housing. Another end of the frame member is pivotally and slidably coupled to the cover. In one embodiment, the frame member is pivotally and slidably coupled to the proximate cover portion via a pin attached to the proximate cover portion and extending through a slot defined by the frame member. A motor is likewise attached to the exterior of the housing and is pivotally coupled to the frame member. The motor causes the frame member to rotate thereby lifting the cover off of the housing.

15 Claims, 5 Drawing Sheets

METHOD AND APPARATUS FOR AUTOMATICALLY LIFTING A COVER

CROSS REFERENCE TO RELATED APPLICATION

This is a continuation-in-part application that claims priority from U.S. application Ser. No. 11/371,635, filed Mar. 8, 2006, which such application is incorporated herein by reference.

FIELD OF INVENTION

This relates to spas and other housings, and more specifically, to methods and apparatuses for automatically lifting a cover off of such housings.

BACKGROUND

Spas are popular fixtures that are used in many homes and hotels. They include a large tub or small pool full of heated water and used for soaking and relaxation. Many spas further include water jets for massage purposes. Spas usually have several independent water circuits with one providing heating and filtration and the others driving the hydrotherapy jets.

The spa tubs are usually relatively shallow and manufactured from fiberglass-reinforced plastic that is formed into shapes that provide a variety of seating arrangements within the tub. Each seat is usually equipped with hydrotherapy jets that allow a forceful flow of water to be directed at various parts of the body. The water flow may be aerated for additional effect, and some or all of the jets may also automatically move or rotate, causing the changing pressure of the water on the body to provide a massage-like effect.

Spas are frequently located outdoors. The spa tubs may be free-standing or recessed within a surrounding deck or ground. If free-standing, they are usually entered by climbing a short staircase of one or two steps and then stepping over the side of the tub onto one of the seating areas. Because many spas are located outdoors, owners usually purchase covers for enclosing the spa tub when not in use. These covers help prevent dirt, leaves and other debris from entering the water. Moreover, they can provide a safety function by preventing small children from falling into the water.

These covers are quite large, and sometimes quite heavy. They frequently are about one inch, or so, in thickness and frequently are constructed of a foam material encased in a flexible covering. Thus it is often cumbersome and difficult for a user to remove the cover prior to using the spa and to place the cover back over the spa when it is no longer in use. It would be desirable, therefore, to have an improved apparatus for the automatic removal of spa covers.

SUMMARY OF THE ILLUSTRATED EMBODIMENTS

An apparatus for lifting a cover from a spa or other housing is provided. A frame member is pivotally attached to the exterior of the housing and is further pivotally and slidably attached to the cover. A motor is likewise attached to the exterior of the housing and is pivotally coupled to the frame member. The motor causes the frame member to rotate thereby lifting the cover off of the housing.

In one aspect, the housing has a housing rim defining a housing opening. The cover has a proximate portion pivotally connected to a distal portion. A motor is disposed adjacent to the housing and is coupled to the cover by a frame member.

The frame member is adapted for rotation by the motor from a first position to a second position and from a second position to a third position.

The frame member is further adapted to lift the proximate portion of the cover from the housing opening by the rotation of the frame member from the first position to the second position while the distal portion of the cover is not lifted from the housing opening. The frame member is further adapted to lift the distal portion of the cover from the housing opening by the rotation of the frame member from the second position to the third position while the proximate cover portion remains lifted from the housing opening. The proximate and distal portions of the cover are disposed on or above an imaginary plane defined by the housing rim when the frame member is in the third position.

In another aspect, the frame member has a proximate end that defines a slot. The apparatus further comprises a pin attached to the cover and extending through the slot.

In another aspect, the apparatus further includes control circuitry, first operator circuitry, and second operator circuitry. The control circuitry supplies electric power to the motor and controls the motor's direction of movement. The motor is adapted to move in a first direction and a second direction. The first operator circuitry supplies a first signal to the control circuitry. A first manual actuator, such as for example a push button, causes the first operator circuitry to supply the first signal to the control circuitry.

The second operator circuitry supplies a second signal to the control circuitry. A second manual actuator causes the second operator circuitry to supply the second signal to the control circuitry. The control circuitry causes the motor to move in the first direction when the control circuitry receives the first signal, but causes the motor to move in the second direction when the control circuitry receives both the first signal and the second signal.

There are additional aspects to the present inventions. It should therefore be understood that the preceding is merely a brief summary of some embodiments and aspects of the present inventions. Additional embodiments and aspects are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

BRIEF DESCRIPTION OF THE DRAWINGS

These and/or other aspects and advantages of the present invention will become apparent and more readily appreciated from the following description of certain embodiments, taken in conjunction with the accompanying drawings of which.

DETAILED DESCRIPTION

Figure 1:
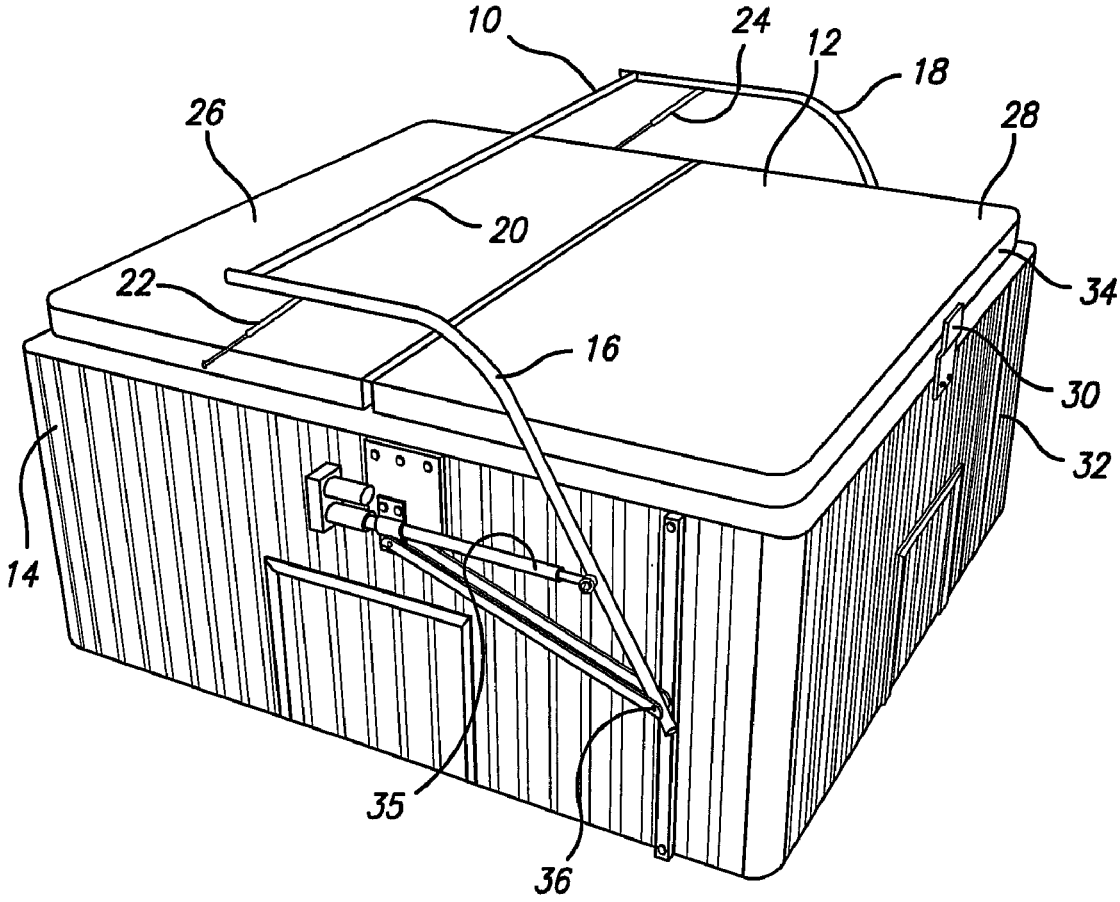
FIG. 1 is a perspective view of an apparatus for lifting a cover from a housing according to one embodiment of the invention.

The following description is of the best mode presently contemplated for carrying out the invention. Reference will be made in detail to embodiments of the present invention, examples of which are illustrated in the accompanying drawings, wherein like reference numerals refer to like elements throughout. It is understood that other embodiments may be used and structural and operational changes may be made without departing from the scope of the present invention.

Referring to FIG. 1, there is shown an apparatus 10 for lifting a cover 12 from a spa 14 in accordance with one embodiment of the invention. Shown is a first frame member 16, a second frame member 18 and a crossbar 20 extending laterally above and across the cover 12, thereby connecting the first and second frame members 16, 18. The cover 12 is constructed of foam encased within a flexible cover and has a proximate portion 26 pivotally connected to a distal portion 28.

A pair of shock absorbers 22, 24 couple the first and second frame members 16, 18 to the proximate portion 26 of the cover 12. A stop 30 is attached to a distal end 32 of the spa 14 and extends upward so that it is disposed adjacent to a distal edge 34 of the cover 12. A motor 35 is secured external to the spa 14 and is pivotally connected to the first frame member 16. One end of the first frame member 16 is pivotally connected at a frame pivot location 36 to the exterior of the spa 14. Although not shown in FIG. 1, a second motor is attached to the second frame member 18 on the opposite side of the spa 14 in the same manner as the illustrated motor 35.

As explained in further detail below, the illustrated motor 35 and the unillustrated motor push the first and second frame members 16, 18 in a direction generally toward the distal end 32 of the spa thereby rotating the first and second frame members 16, 18 about their respective frame pivot locations 36. The proximate portion 26 of the cover 12 is thereby lifted from the spa 14, followed by the distal portion 28 of the cover 12. The stop 30 prevents lateral movement of the cover distal edge 34 thereby preventing the distal portion 28 of the cover 12 from falling from the distal end 32 of the spa 14.

FIGS. 2-5 show an alternative embodiment of the invention wherein its operation can be seen in greater detail. Shown is a housing 42, such as for example a spa, having an exterior 44, an interior 46 and a rim 104 defining an opening 98. The rim 104 further defines an imaginary plane 82 (FIG. 5) extending beyond the housing 42. The housing 42 has a housing proximate end 48 defining a proximate portion 50 of the opening 98 and a distal end 52 defining a distal portion 54 of the opening 98.

A cover 56 is adapted to fit over the opening 98 and has a proximate edge 58 adjacent to a proximate portion 60 of the cover 56 and a distal edge 62 adjacent to a distal portion 64 of the cover 56. The cover is constructed of two or more flexible foam sections encased within a flexible cover so that the proximate cover portion 60 is pivotally connected to the distal cover portion 64 at a cover connection location 102. The proximate cover portion 60 is adapted to cover the proximate portion 50 of the housing opening 98, and the distal cover portion 64 is adapted to cover the distal portion 54 of the opening 98. The cover 56 has a lower surface 78 and an upper surface 80.

A mounting assembly 86 comprised of a plurality of metal members is attached to the housing exterior 44 and is used for securing a frame member 66 and a motor 88 to the housing exterior 44. The frame member 66 has a proximate end 68 and a distal end 70. The distal end 70 is pivotally attached at a pivot location 72 to the mounting assembly 86, and the frame proximate end 68 is pivotally attached to one end of a shock absorber 74. The other end of the shock absorber 74 is pivotally attached to a cover clamp 76 which, in turn, is secured to the proximate portion 60 of the cover 56. The frame member 66 further has an arcuate-shaped portion 84 disposed between the frame proximate and distal ends 68, 70. The arcuate-shaped portion 84 is spaced-apart from and extends above the cover upper surface 80 when the cover 56 is in the fully closed position as shown in FIG. 2.

One end of a cross bar 100 is connected to the frame member 66 between its proximate and distal ends 68, 70. The cross bar 100 extends laterally across the upper surface 80 of the cover 56 and is disposed in a spaced-apart relationship above the upper cover surface 80 when the cover is in the fully closed position as shown in FIG. 2. The other end of the cross bar 100 is connected to another frame member (not shown) on the opposite side of the housing 42 and having the same arrangement as that shown in FIGS. 2-5.

Figure 2:
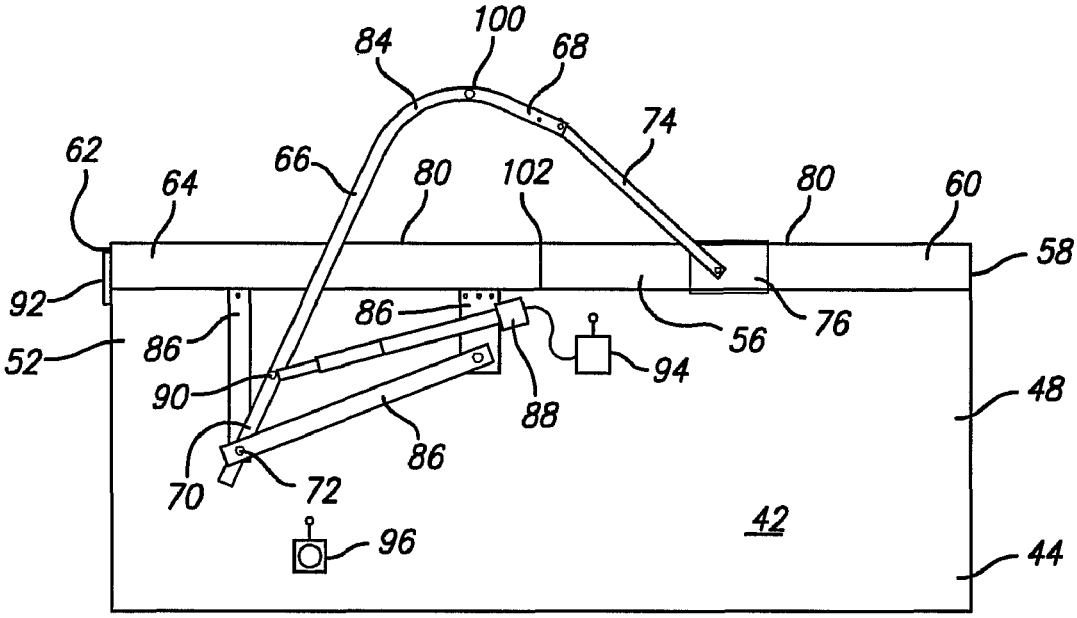
FIG. 2 is a side plan view of an apparatus for lifting a cover from a housing according to another embodiment of the invention.

As best seen in FIG. 2, when the cover is fully closed the shock absorber 74 applies a biasing force in a generally downward direction against the proximate cover portion 60 and the proximate end 48 of the housing 42, thereby providing a safety feature. Should a user of the housing or spa 42 become entrapped in the housing interior 46 when the cover 56 is in the closed position, the user can push upward on the proximate cover portion 60, and the shock absorber 74 will permit the proximate cover portion 60 to rotate upward about the cover connection location 102 so that the user can escape. (While the embodiment of FIG. 2 employs a shock absorber, other embodiments of the invention use other biasing devices, such as coils, leaf springs, clips, and other resilient members, etc. In yet other embodiments, however, no shock absorbers or other biasing devices are employed at all, although this safety feature will be lacking. Rather, the proximate end 68 of the frame member 66 is pivotally attached directly to the cover clamp 76.)

One end of a motor 88 is attached to the mounting assembly 86, and the other end of the motor 88 is pivotally attached to the frame distal end 70 at a motor attachment point 90. In this embodiment, the motor 88 is a linear drive motor. An exemplary motor can be obtained from Jaeger USA, Inc., Atlanta, Ga. as model number Harl 3624, sold under the SUPER JACK trademark. In alternative embodiments, however, other types and designs of motors may be used as well.

Figure 5:
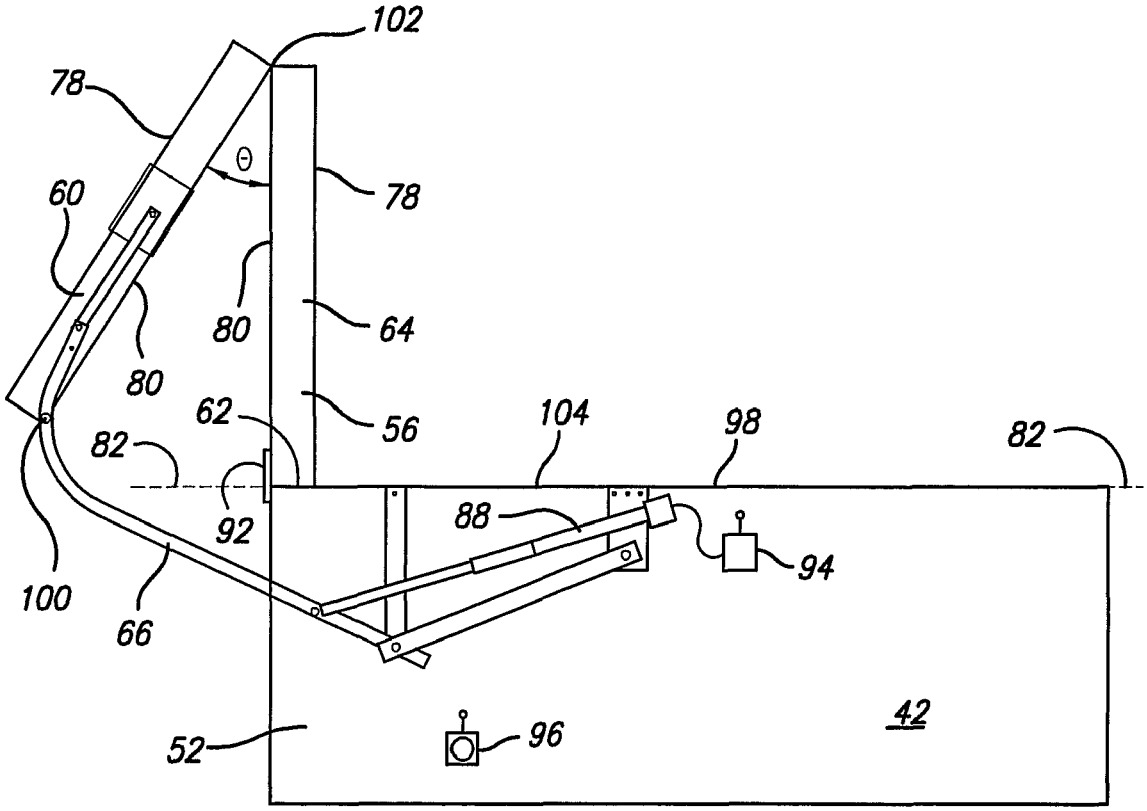
FIG. 5 is a side plan view of the apparatus of FIG. 2 with the cover fully removed from the housing.

A stop 92 is attached to the exterior 44 of the housing 42 at the distal end 52 and extends upward so that the stop 92 is disposed adjacent to the distal edge 62 of the cover 56. The stop 92 prevents the distal edge 62 of the cover 56 from moving laterally away from the housing proximate end 48 while the distal portion 64 of the cover 56 is opening and prevents the distal portion 64 from falling behind the housing distal end 52. In the illustrated embodiment, the stop 92 is a bracket member. Because the cover 56 is constructed of flexible foam encased in a flexible cover, the distal edge 62 of the cover 56 can shift and rotate as the distal cover portion 64 is being raised, and can rest against the distal end 52 of the housing 42 while the stop 92 abuts the distal portion 64 of the cover 56 when it is fully raised as best seen in FIG. 5. Alternative embodiments of the stop 92 however include a hinge so that the distal edge 62 of the cover 56 is attached to one end of the hinged stop thereby permitting the distal edge 62 to rotate with the stop 92 as the cover distal end 64 is being raised.

While FIGS. 2-5 illustrate a cover lifting apparatus as shown in a plan view of one side of the housing 42, it will be understood that the opposite side of the housing 42 includes a like arrangement, including another frame member, shock absorber, motor, mounting assembly and cover clamp.

Figure 3:
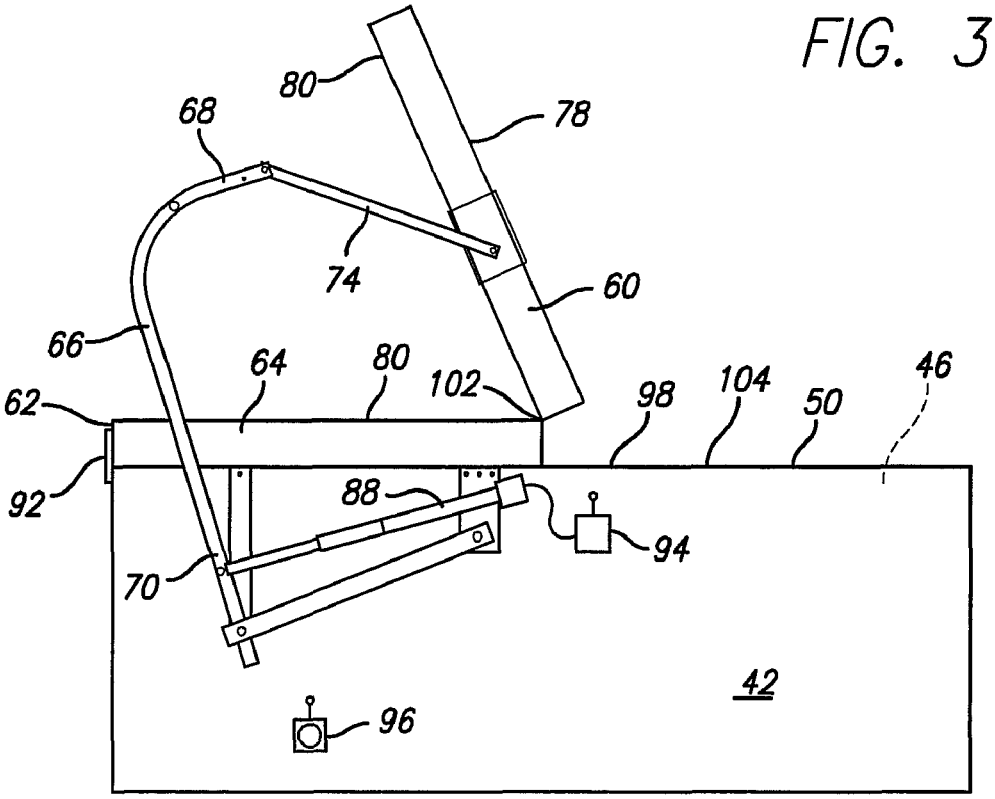
FIG. 3 is a side plan view of the apparatus of FIG. 2 with a portion of the cover lifted from the housing.

FIGS. 2-5 show various positions of the frame member 66 and the motor 88 as the cover 56 is being lifted from the housing 42. Starting from the fully closed orientation of the cover 56 as shown in FIG. 2, the motor 88 pushes the motor attachment location 90 of the frame member 66 in a direction that is generally away from the housing proximate end 48. This causes the frame member 66 to rotate in a counterclockwise direction (as viewed in FIGS. 2-5) about the frame pivot location 72. As seen in FIG. 3 when the frame member 66 is rotated to a first position, the proximate cover portion 60 is rotated about the cover connection location 102 and lifted from the proximate portion 50 of the opening 98 while the distal cover portion 64 remains in a generally horizontal orientation over the distal portion 54 of the opening 98.

Figure 4:
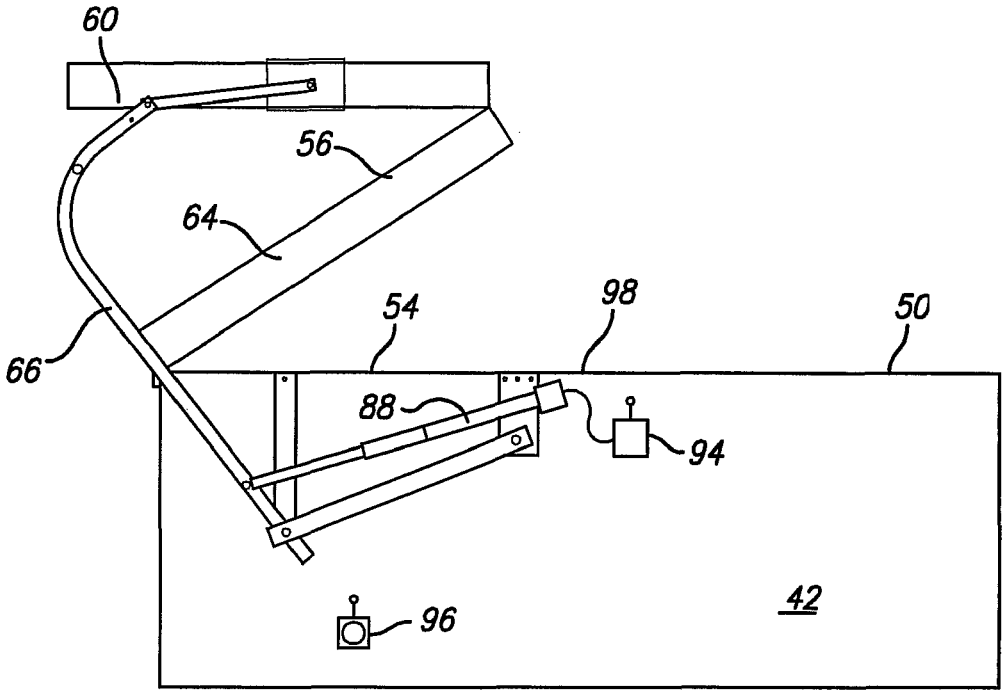
FIG. 4 is a side plan view of the apparatus of FIG. 2 with another portion of the cover lifted from the housing.

Referring now to FIG. 4, as the motor 88 continues to push the frame member 66 in a further counterclockwise direction, the distal cover portion 64 of the cover 56 is rotated and lifted from the distal portion 54 of the opening 98 while the proximate cover portion 60 remains lifted from the proximate portion 50 of the opening 98. Finally when the motor 88 has moved the frame member 66 to the furthest counterclockwise location as seen in FIG. 5, both the proximate and distal cover portions 60, 64 are fully lifted from the opening 98 and are disposed on or above the imaginary plane 82 defined by the housing rim 104. The distal cover portion 64 is in a generally vertical position, and the proximate cover portion 60 is folded back via the cover connection location 102 so that the proximate cover portion 60 rests on the cross bar 100 and so that an acute angle θ is formed by the upper surface 80 of the cover 56. The stop 92 prevents the distal cover edge 62 from moving laterally off of the housing 42 and abuts the distal cover portion 64.

It will be appreciated that the above-described movement is reversed for returning the cover 56 over the opening 98 of the housing 42.

In order to control the supply of electrical power to the motor 88 and the motor's direction of movement, control circuitry 94 is provided. The control circuitry 94 includes receiver circuitry for receiving a first wireless signal and for supplying electrical power to the motor 88 upon receipt of the signal. A wireless transmitter (not shown) includes circuitry for the transmission of the first wireless signal upon manual actuation by a user of an actuator, such as a button, on the transmitter. Such a transmitter is similar to the wireless garage door opener transmitters that are currently in common use. Alternative embodiments however do not employ a wireless transmitter. Rather, a manual actuator, such as a button, is part of the control circuitry 94 So that a signal is sent via a wired connection.

Safety circuitry 96 is located in the vicinity of the control circuitry 94 and is in wireless communication with the control circuitry 94. The safety circuitry 96 includes a manual actuator, such as a button, that when manually actuated transmits a second wireless signal for receipt by the control circuitry 94. (In alternative embodiments, however, the connection between the safety circuitry 96 and the control circuitry 94 could be wired.)

The motor control circuitry 94 operates as follows. When the frame member 66 is in its closed orientation, as in FIG. 1, movement of the manual actuator on the wireless transmitter sends the first wireless signal to the control circuitry 94. Upon receipt of this signal, the control circuitry 94 will cause the motor 88 to move in an opening direction. When the frame member 66 is in its fully opened orientation, as in FIG. 5, movement of the manual actuator on the wireless transmitter will again send the first signal to the control circuitry 94. However at this point in time, receipt of the first signal alone will not cause the motor 88 to move in the closing direction. Rather, the second signal from the safety circuitry 96 must also be received by the control circuitry 94 which will cause the motor 88 to move in the closed direction only upon receipt of both the first and second signals.

The manual actuator portion of the safety circuitry 96 is located sufficiently far from the housing interior 46 so that a user is unable to manually reach the actuator while the user is in the housing interior 46. By requiring the user to actuate the manual safety circuitry actuator 96 (while the user is located outside of the housing interior 46) and at the same time actuate the other manual actuator on the wireless transmitter, a safety feature is provided so that the cover 56 is not likely to close on the user while the user is in the housing interior 46.

FIGS. 6-9 show yet another alternative embodiment of the invention. While this embodiment has many similarities with the previously-described embodiment, some differences, which will be discussed in more detail below, include a slot and pin arrangement for coupling the frame member to the cover so that this frame member can move relative to the cover at the connection point. As will be shown below, this permits a lower profile of the frame member relative to the housing or spa, dispenses with the need for a cross bar, and allows for a more compact arrangement of the housing cover behind the housing when the cover is fully opened.

Referring now to FIGS. 6-9, shown is a housing 130, such as for example a spa, having an exterior 132, an interior 134 and a rim 136 defining an opening 138. The rim 136 further defines an imaginary plane 139 (FIG. 9) extending beyond the housing 130. The housing 130 has a housing proximate end 140 defining a proximate portion 142 of the opening 138 and a distal end 144 defining a distal portion 146 of the opening 138.

A cover 148 is adapted to fit over the opening 138 and has a proximate edge 150 adjacent to a proximate portion 152 of the cover 148 and a distal edge 154 adjacent to a distal portion 156 of the cover 148. The cover is constructed of two or more flexible foam sections encased within a flexible cover so that the proximate cover portion 152 is pivotally connected to the distal cover portion 156 at a cover connection location 158. The proximate cover portion 152 is adapted to cover the proximate portion 142 of the housing opening 138, and the distal cover portion 156 is adapted to cover the distal portion 146 of the opening 138. The cover 148 has a lower surface 160 and an upper surface 162.

A mounting assembly 164 comprised of a plurality of metal members is attached to the housing exterior 132 and is used for securing a frame member 166 and a motor 168 to the housing exterior 132. The frame member 166 has a proximate end 170 and a distal end 172. One end of the motor 168 is attached to the mounting assembly 164, and the other end of the motor 168 is pivotally attached to the frame distal end 172 at a motor attachment point 182. The distal end 172 in turn is pivotally attached at a pivot location 174 to the mounting assembly 164, and the frame proximate end 170 is pivotally and slidably coupled to the proximate portion 152 of the cover 148.

Figure 6:
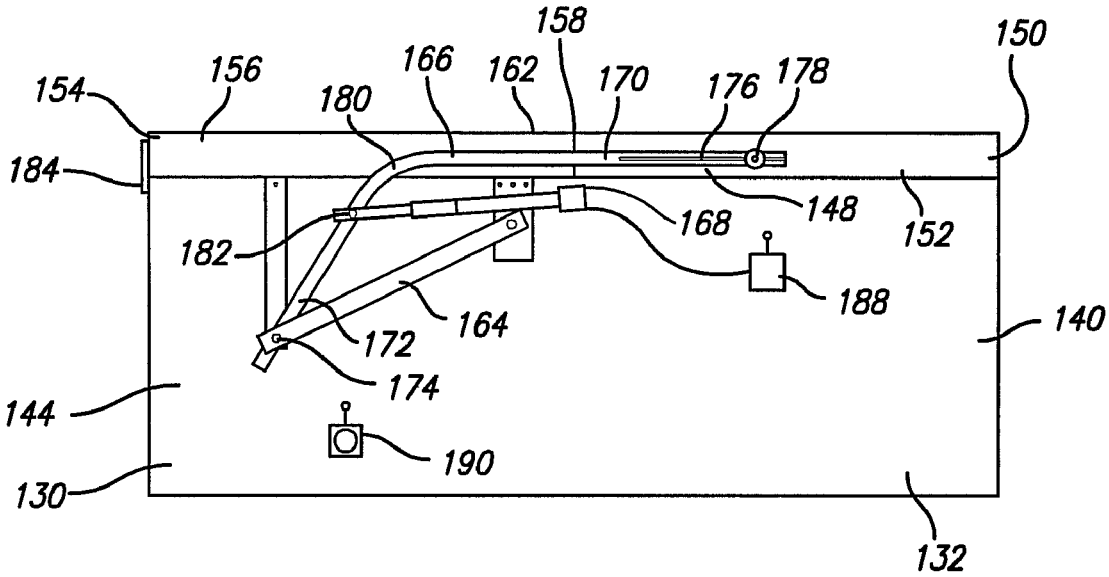
FIG. 6 is a is a side plan view of an apparatus for lifting a cover from a housing according to yet another embodiment of the invention.

In the embodiment of FIGS. 6-9, this coupling between the frame proximate end 170 and the proximate portion 152 of the cover 148 is achieved via a longitudinally-oriented slot 176 (defined by the frame member proximate end 170) and a pin 178 attached to the proximate portion 152 of the cover 148 and extending through the slot 176. However other embodiments may use other couplings or connection mechanisms as well that permit the frame member 166 to move relative to the proximate portion 152 of the cover 148. The frame member 166 further has an arcuate-shaped portion 180 disposed between the frame proximate and distal ends 170, 172. The arcuate-shaped portion 180 is disposed so that no part of this portion 180 extends above the cover upper surface 162 when the cover 148 is in the fully closed position as shown in FIG. 6. Indeed, in the illustrated embodiment no part of the entire frame member 166 extends above the cover upper surface 162 when the cover 148 is in the fully closed position.

A stop 184 is attached to the exterior 132 of the housing 130 at the distal end 144 and extends upward so that the stop 184 is disposed adjacent to the distal edge 154 of the cover 148. The stop 184 prevents the distal edge 154 of the cover 148 from moving laterally away from the housing proximate end 140 while the distal portion 156 of the cover 148 is opening and prevents the distal portion 156 from falling behind the housing distal end 144. In the illustrated embodiment, the stop 184 is a bracket member. Alternative embodiments of a stop however include a hinge so that the distal edge 154 of the cover 148 is attached to one end of the hinged stop thereby permitting the distal edge 154 to rotate with the stop as the cover distal end 156 is being raised.

While FIGS. 6-9 illustrate a cover lifting apparatus as shown in a plan view of one side of the housing 130, it will be understood that the opposite side of the housing 130 includes a like arrangement, including another frame member, motor, mounting assembly and cover clamp. However unlike the embodiment of FIGS. 2-5, the embodiment of FIGS. 6-9 does not include a cross bar connecting the frame members.

Figure 7:
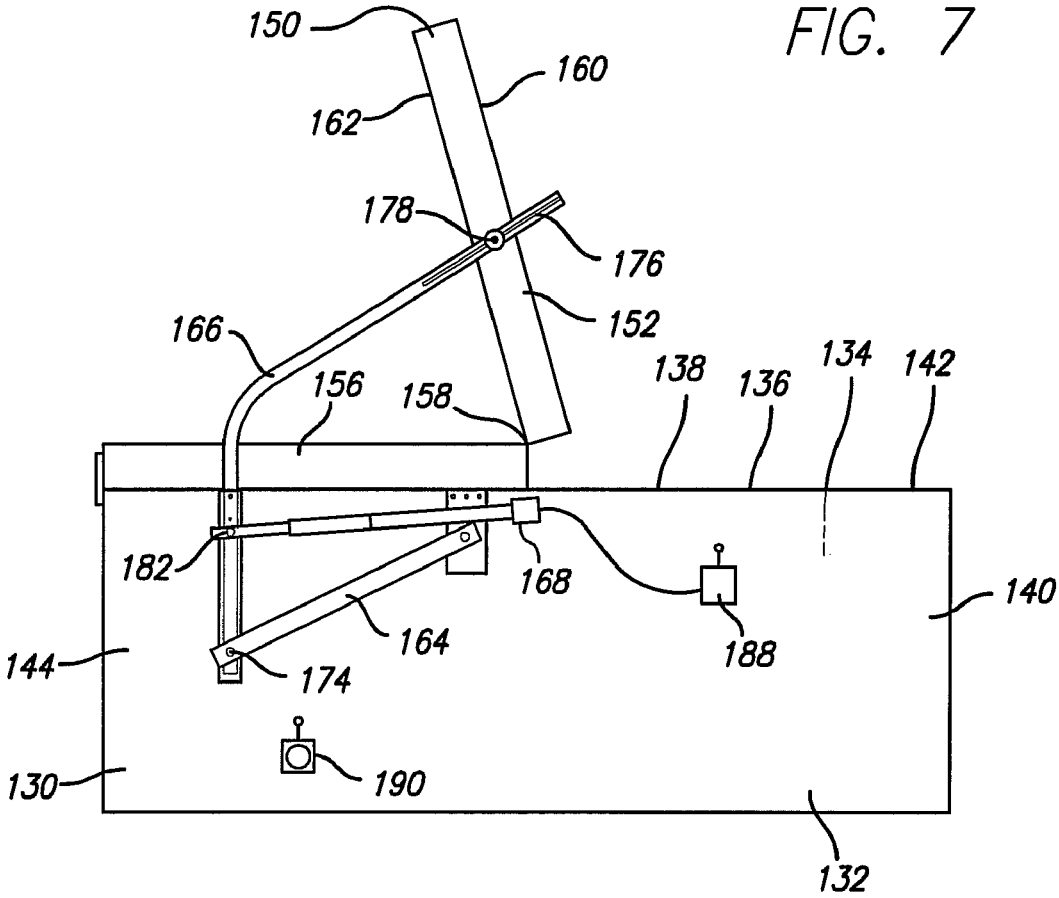
FIG. 7 is a is a side plan view of the apparatus of FIG. 6 with a portion of the cover lifted from the housing.

FIGS. 6-9 show various positions of the frame member 166 and the motor 168 as the cover 148 is being lifted from the housing 130. Starting from the fully closed orientation of the cover 148 as shown in FIG. 6, the motor 168 pushes the motor attachment location 182 of the frame member 166 in a direction that is generally away from the housing proximate end 140. This causes the frame member 166 to rotate in a counterclockwise direction (as viewed in FIGS. 6-9) about the frame pivot location 174. As seen in FIG. 7 when the frame member 166 is rotated to a first position, the proximate cover portion 152 is rotated about the cover connection location 158 and lifted from the proximate portion 142 of the opening 138 while the distal cover portion 156 remains in a generally horizontal orientation over the distal portion 146 of the opening 138. As the proximate cover portion 152 is lifted, the frame member 166 rotates about the pin 178, and the pin 178 slides in the slot 176 located in the frame member 166, thus allowing the proximate cover portion 152 to move smoothly as it rotates into an open position.

Figure 8:
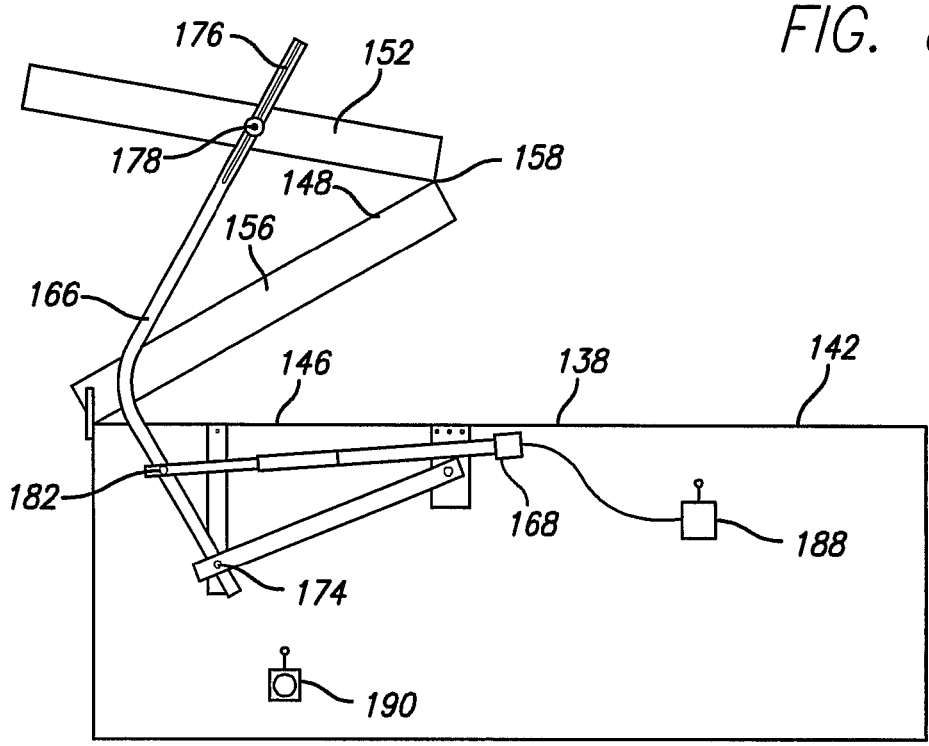
FIG. 8 is a is a side plan view of the apparatus of FIG. 6 with another portion of the cover lifted from the housing.
Figure 9:
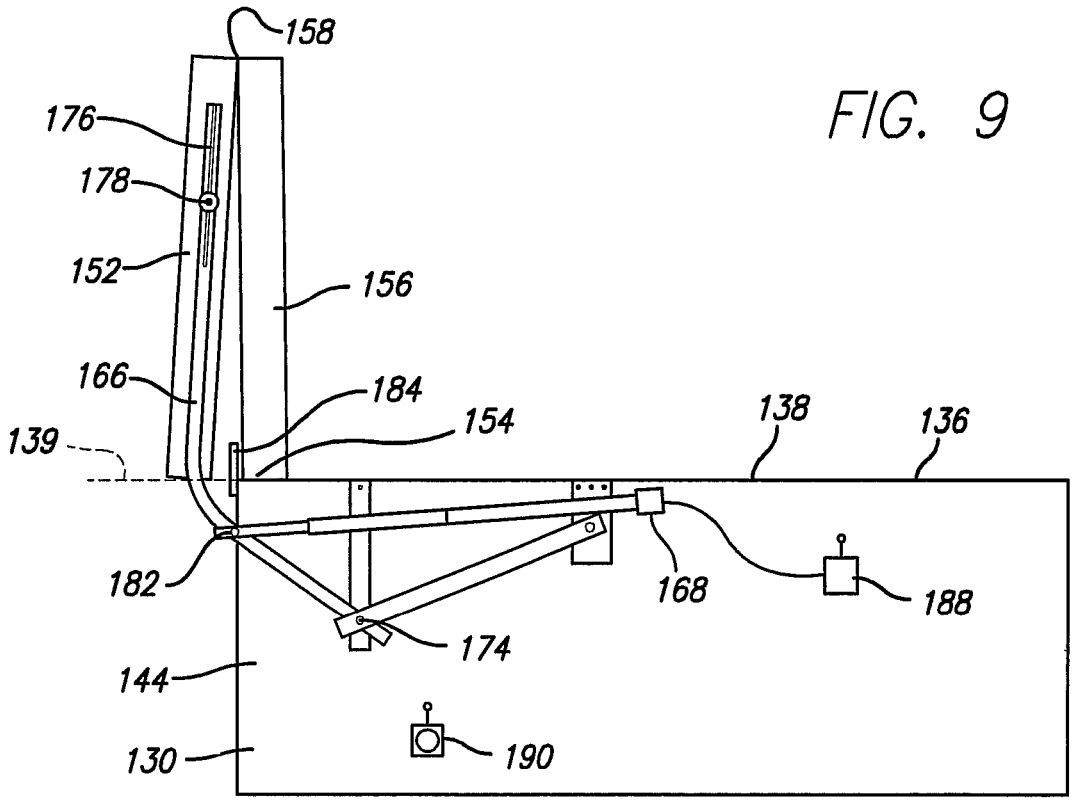
FIG. 9 is a is a side plan view of the apparatus of FIG. 6 with the cover fully removed from the housing.

Referring now to FIG. 8, as the motor 168 continues to push the frame member 166 in a further counterclockwise direction, the distal cover portion 156 of the cover 148 is rotated and lifted from the distal portion 146 of the opening 138 while the proximate cover portion 152 remains lifted from the proximate portion 142 of the opening 138. Finally when the motor 168 has moved the frame member 166 to the furthest counterclockwise location as seen in FIG. 9, both the proximate and distal cover portions 152, 156 are fully lifted from the opening 138 and are disposed on or above the imaginary plane 139 defined by the housing rim 136. The distal cover portion 156 is in a generally vertical position, and the proximate cover portion 152 is folded back via the cover connection location 158 So that the proximate cover portion 152 rests in a nearly vertical position and is parallel or nearly parallel to the distal cover portion 156. The pin 178 has slid further down the slot 176 in order to allow the proximate cover portion 152 to fold back into this position. Because there is no cross bar, the proximate cover portion 152 is able to fall closer to he distal cover portion 156 thus requiring less space behind the distal housing end 144 as compared with the embodiment of FIGS. 2-5. The stop 184 prevents the distal cover edge 154 from moving laterally off of the housing 130 and abuts the distal cover portion 156.

It will be appreciated that the above-described movement is reversed for returning the cover 148 over the opening 138 of the housing 130.

In order to control the supply of electrical power to the motor 168 and the motor's direction of movement, control circuitry 188 is provided. The control circuitry 188 includes receiver circuitry for receiving a first wireless signal and for supplying electrical power to the motor 168 upon receipt of the signal. A wireless transmitter (not shown) includes circuitry for the transmission of the first wireless signal upon manual actuation by a user of an actuator, such as a button, on the transmitter. Such a transmitter is similar to the wireless garage door opener transmitters that are currently in common use. Alternative embodiments however do not employ a wireless transmitter. Rather, a manual actuator, such as a button, is part of the control circuitry 188 So that a signal is sent via a wired connection.

Safety circuitry 190 is located in the vicinity of the control circuitry 188 and is in wireless communication with the control circuitry 188. The safety circuitry 190 includes a manual actuator, such as a button, that when manually actuated transmits a second wireless signal for receipt by the control circuitry 188. (In alternative embodiments, however, the connection between the safety circuitry 190 and the control circuitry 188 could be wired.) The control circuitry 188 and the safety circuitry 190 operate in essentially the same manner as described above in connection with the embodiment of FIGS. 2-5.

Thus FIGS. 6-9 further illustrate a method of lifting the cover 148 from the housing 130. The proximate cover portion 152 of the cover 148 is lifted from a generally horizontal orientation over the proximate portion 142 of the opening 138 using the motor 188 coupled to the frame member 166. The frame member 166, in turn, is pivotally and slidably coupled to the cover 148. The distal portion 156 of the cover 148 remains in a generally horizontal orientation over the distal portion 146 of the opening 138 while the proximate cover portion 152 is being lifted due to the pivotal connection between the proximate and distal cover portions 152, 156.

Then the distal cover portion 156 of the cover 148 is lifted from its generally horizontal orientation over the distal portion 146 of the opening 138 using the motor 188 and the frame member 166. The proximate cover portion 152 no longer covers the proximate portion 142 of the opening 138 while the distal cover portion 156 is being lifted. The distal edge 154 of the cover 148 is prevented from moving laterally away from the housing proximate end 140 while the distal portion 156 of the cover 148 is being lifted from the opening 138.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. An apparatus for lifting a cover from an opening of a housing having an exterior and an interior, wherein the housing further has a housing proximate end defining a proximate portion of the opening and a housing distal end defining a distal portion of the opening, wherein the cover has a proximate portion of the cover pivotally connected to a distal portion of the cover, wherein the proximate cover portion is adapted to cover the proximate portion of the opening, and wherein the distal cover portion is adapted to cover the distal portion of the opening, the apparatus comprising:

a first frame member having a first frame member proximate end and a first frame member distal end, wherein the first frame member distal end is pivotally attached at a frame pivot location to the exterior of the housing, and wherein the first frame member proximate end is pivotally and slidably coupled to the proximate cover portion of the cover; and a motor coupled to the first frame member and adapted to rotate the first frame member about the frame pivot location from a frame first position to a frame second position, and from the frame second position to a frame third position, wherein the proximate cover portion is disposed in a generally horizontal orientation over the proximate portion of the opening and the distal cover portion is disposed in a generally horizontal orientation over the distal portion of the opening when the first frame member is in the frame first position, wherein the proximate cover portion is lifted from the proximate portion of the opening and the distal cover portion is disposed in a generally horizontal orientation over the distal portion of the opening when the first frame member is in the frame second position, and wherein the proximate cover portion is lifted from the proximate portion of the opening and the distal cover portion is lifted from the distal portion of the opening when the first frame member is in the frame third position;

wherein the first frame member proximate end defines an elongated slot and wherein the apparatus further comprises a pin attached to the proximate cover portion of the cover and extending through the elongated slot for longitudinal movement therein.

2. The apparatus of claim 1 wherein the cover has an upper surface and a lower surface, and wherein no part of the first frame member extends above the upper surface of the cover when the first frame member is in the frame first position.

3. The apparatus of claim 1 wherein the cover has an upper surface and a lower surface, wherein the first frame member has an arcuate-shaped portion disposed between the first frame member proximate end and the first frame member distal end, and wherein no part of the arcuate-shaped portion extends above the upper surface of the cover when the first frame member is in the frame first position.

4. The apparatus of claim 1 wherein the motor is pivotally attached to the first frame member distal end at a motor attachment location on the first frame member distal end, and wherein the motor is adapted to move the motor attachment location of the first frame member in a direction generally away from the housing proximate end when the first frame member is rotated from the frame first position to the frame second position.

5. The apparatus of claim 1 wherein the housing has a housing rim defining the opening of the housing and further defining an imaginary plane extending beyond the housing, and wherein the proximate and distal portions of the cover are disposed on or above the imaginary plane when the first frame member is in the third position.

6. The apparatus of claim 1 wherein the cover has a proximate edge adjacent to the proximate portion of the cover and a distal edge adjacent to the distal portion of the cover, and wherein the apparatus further comprises a stop attached to the exterior of the housing for preventing a generally lateral movement of the cover distal edge in a direction generally away from the housing proximate end.

7. The apparatus of claim 1 wherein the motor is adapted to move in a first direction and a second direction, the apparatus further comprising:

control circuitry for supplying electric power to the motor and for controlling the motor's direction of movement;

first operator circuitry for supplying a first signal to the control circuitry;

a first manual actuator for causing the first operator circuitry to supply the first signal to the control circuitry;

second operator circuitry for supplying a second signal to the control circuitry; and a second manual actuator for causing the second operator circuitry to supply the second signal to the control circuitry, wherein the control circuitry causes the motor to move in the first direction when the control circuitry receives the first signal, and wherein the control circuitry causes the motor to move in the second direction when the control circuitry receives both the first signal and the second signal.

8. The apparatus of claim 7 wherein the first operator circuitry includes circuitry for the wireless transmission of the first signal, and wherein the control circuitry includes circuitry for the wireless receipt of the first signal.

9. The apparatus of claim 8 wherein the second operator circuitry includes circuitry for the wireless transmission of the second signal, and wherein the control circuitry includes circuitry for the wireless receipt of the second signal.

10. The apparatus of claim 1 further comprising:

a second frame member having a second frame member proximate end and a second frame member distal end, wherein the second frame member distal end is pivotally connected to the housing at a second frame pivot location, and wherein the second frame member proximate end is pivotally and slidably coupled to the proximate cover portion of the cover.

11. The apparatus of claim 10 further comprising a second motor coupled to the second frame member and adapted to rotate the second frame member about the second frame pivot location.

12. The apparatus of claim 1 wherein the housing is a spa.

13. A method of lifting a cover from a housing having an opening, wherein the housing has a proximate housing end defining a proximate portion of the opening and having a distal housing end defining a distal portion of the opening, the method comprising:

providing means for lifting a proximate cover portion of the cover from a generally horizontal orientation over the proximate portion of the opening using a motor coupled to a frame member, wherein the frame member is pivotally and slidably coupled to the proximate cover portion, wherein a distal portion of the cover remains in a generally horizontal orientation over a distal portion of the opening while the proximate cover portion is being lifted, and wherein the proximate cover portion is pivotally connected to the distal cover portion; and providing means for lifting the distal cover portion of the cover from the generally horizontal orientation over the distal portion of the opening using the motor and the frame member, wherein the proximate cover portion no longer covers the proximate portion of the housing opening while the distal cover portion is being lifted, wherein a distal edge of the cover is prevented from moving in a generally lateral direction away from the housing proximate end, and wherein the distal edge of the cover is adjacent to the distal portion of the cover;

wherein the frame member is pivotally and slidablv coupled to the proximate cover portion via a pin attached to the proximate cover portion and extending through an elongated slot defined by the frame member for longitudinal movement therein.

14. The method of claim 13 wherein the cover has an upper surface and a lower surface, and wherein no part of the frame member extends above the upper surface of the cover when the proximate cover portion and the distal cover portion are both in the generally horizontal orientation.

15. The method of claim 13 wherein the cover has an upper surface and a lower surface, wherein the frame member has an arcuate-shaped portion disposed between a frame member proximate end attached to the proximate cover portion and a frame member distal end attached to an exterior of the housing, and wherein no portion of the arcuate-shaped portion extends above the upper surface of the cover when the proximate cover portion and the distal cover portion are both in the generally horizontal orientation.

* * * * *